US011162642B2

(12) United States Patent
Pettersen et al.

(10) Patent No.: US 11,162,642 B2
(45) Date of Patent: Nov. 2, 2021

(54) INFLOW DEVICE

(71) Applicant: EQUINOR ENERGY AS, Stavanger (NO)

(72) Inventors: Ketil Pettersen, Stavanger (NO); Tor Kindsbekken Kjeldby, Stavanger (NO)

(73) Assignee: EQUINOR ENERGY AS, Stavanger (NO)

( * ) Notice: Subject to any disclaimer, the term of this patent is extended or adjusted under 35 U.S.C. 154(b) by 59 days.

(21) Appl. No.: 16/604,861

(22) PCT Filed: Apr. 5, 2018

(86) PCT No.: PCT/NO2018/050092
§ 371 (c)(1),
(2) Date: Oct. 11, 2019

(87) PCT Pub. No.: WO2018/190723
PCT Pub. Date: Oct. 18, 2018

(65) Prior Publication Data

US 2020/0363017 A1 Nov. 19, 2020

(30) Foreign Application Priority Data

Apr. 12, 2017 (GB) ..... 1705921

(51) Int. Cl.
*F17D 1/17* (2006.01)
*E21B 43/01* (2006.01)
(Continued)

(52) U.S. Cl.
CPC ..... *F17D 1/17* (2013.01); *E21B 43/01* (2013.01); *F04B 9/08* (2013.01); *F15D 1/0055* (2013.01); *F15D 1/02* (2013.01); *F15D 1/06* (2013.01)

(58) Field of Classification Search
CPC ..... F16D 1/17; F04B 9/08; F15D 1/02; F15D 1/0055; F15D 1/06; F15D 1/08;
(Continued)

(56) References Cited

U.S. PATENT DOCUMENTS 3,307,567 A 3/1967 Gogarty et al.
3,425,429 A 2/1969 Kane
(Continued)

FOREIGN PATENT DOCUMENTS

GB 1168608 10/1969
GB 2 180 957 A 4/1987

OTHER PUBLICATIONS

Frigaard et al., "Compressible displacement of waxy crude oils in long pipeline startup flows." Elsevier, J. Non-Newtonian Fluid Mech., vol. 147, 2007, pp. 45-64.
(Continued)

*Primary Examiner* — Michael R Reid
(74) *Attorney, Agent, or Firm* — Birch, Stewart, Kolasch & Birch, LLP

(57) ABSTRACT

A method of starting up flow of viscous oil in a pipeline, wherein the pipeline has an inlet and an outlet and wherein the viscous oil is initially stationary within the pipeline, includes supplying water to a first section of the pipeline through an inflow control device; initiating a flow of viscous oil within the first section towards the outlet by pressurising the water; supplying water to a second section of the pipeline through a further inflow wherein the first section is closer to the outlet of the pipeline than the second section; and initiating a flow of viscous oil within the second section towards the outlet by pressurising the water.

8 Claims, 8 Drawing Sheets

(51) Int. Cl.

| | |
|---|---|
| ***F15D 1/02*** | (2006.01) |
| ***F15D 1/00*** | (2006.01) |
| ***F15D 1/06*** | (2006.01) |
| ***F04B 9/08*** | (2006.01) |

(58) Field of Classification Search
CPC ..... F15D 1/065; E21B 43/01; B67D 7/3254; B67D 7/3263
USPC ..... 417/54–55; 137/13
See application file for complete search history.

(56) References Cited

U.S. PATENT DOCUMENTS

| | | | |
|---|---|---|---|
| 3,502,103 | A | 3/1970 | Verschuur |
| 3,826,279 | A | 7/1974 | Verschuur |
| 3,977,469 | A | 8/1976 | Broussard et al. |
| 4,745,937 | A | 5/1988 | Zagustin et al. |
| 4,753,261 | A | 6/1988 | Zagustin et al. |
| 2011/0220212 | A1 | 9/2011 | Vom et al. |
| 2018/0030823 | A1 | 2/2018 | Nedwed et al. |

OTHER PUBLICATIONS

International Preliminary Report on Patentability and Written Opinion of the International Searching Authority, dated Oct. 24, 2019, for International Application No. PCT/NO2018/050092.
International Search Report, dated Jun. 18, 2018, for International Application No. PCT/NO2018/050092.
United Kingdom Combined Search and Examination Report, dated Sep. 29, 2017, for United Kingdom Application No. 1705921.3.

INFLOW DEVICE

BACKGROUND OF THE INVENTION

1. Field of the Invention

The invention relates to long distance transport of hydrocarbons, and in particular to transport of multiphase hydrocarbons including viscous oil.

2. Description of Related Art

Hydrocarbons can be produced offshore in a well and are then transported to a storage facility such as a floating production storage and offloading (FPSO) unit. The distance between the well and the FPSO determines the length of the flow lines which connect the well and the FPSO. The FPSO may not be able to be positioned immediately above the well due to seabed topology or other reasons, such as the FPSO being connected to a plurality of wells. If the hydrocarbons consist of viscous oil, then it will be difficult to transport the oil through a flow line. Increasing the pressure to push the viscous oil through a flowline is only possible within a limited range of pressures and only for relatively short flowlines. One solution which has been considered is adding water to the viscous oil near the well to 'flip' the phase from oil-continuous to water-continuous. Oil continuous refers to a water-in-oil emulsion which consists of water droplets suspended in a continuous oil phase. Water-continuous refers to an oil-in-water emulsion which consists of oil droplets providing in a water-continuous phase. The water-continuous phase has a much lower viscosity than the oil-continuous phase and can therefore be transported over larger distances.

SUMMARY OF THE INVENTION

According to a first aspect of the invention, there is provided a method of starting up flow of viscous oil in a pipeline, wherein the pipeline has an inlet and an outlet and wherein the viscous oil is initially stationary within the pipeline, the method comprising: supplying water to a first section of the pipeline through an inflow control device; initiating a flow of viscous oil within the first section towards the outlet by pressurising said water; supplying water to a second section of the pipeline through a further inflow wherein the first section is closer to the outlet of the pipeline than the second section; and initiating a flow of viscous oil within the second section towards the outlet by pressurising said water.

The viscous oil may initially be in an oil-continuous phase and the phase may be flipped in the first section to water-continuous by the step of supplying water. Subsequently, the phase in the second section to water-continuous may be flipped by the step of supplying water after flipping the phase in the first section to water continuous. The amount of water supplied to the first or second section may be reduced after initiating the flow of viscous oil.

The method may further comprise repeating said steps of supplying water and initiating a flow of viscous oil for a plurality of further sections, wherein said steps of supplying water and initiating a flow for each one of a plurality of further section takes place before said steps of supplying water and initiating a flow for any other one of the plurality of further sections which are closer to the inlet than each one of the plurality of further sections.

The supplying of water may be controlled with an inflow control device, such as an autonomous inflow valve, or a valve which is controlled locally or remotely with a controller.

The flow of viscous oil may be laminar flow. Water may be supplied through a conduit parallel to the pipeline and the water may flow in a direction opposite to the flow of viscous oil.

According to a second aspect of the invention, there is provided a system for transporting viscous oil, the system comprising: a pipeline for transporting oil; a conduit for supplying water to the pipeline; at least two inflow devices connecting the pipeline to the conduit, wherein the inflow devices are distributed along the longitudinal direction of the pipeline.

The conduit may be a second pipeline provided at least partially parallel to the pipeline, and the system may further comprise a plurality of flow channels from the second pipeline to the pipeline. The conduit may be a second pipeline provided concentrically around the pipeline. The inflow devices may be autonomous valves or controlled valves and the system may further comprise controllers for controlling the controlled valves.

The system may further comprise a pump for pressurising the water. The pipeline may further comprise an outlet connected to a floating production storage and offloading unit, an oil platform or a land based production facility, and the pipeline may comprise an inlet connected to a well.

Some embodiments of the invention will now be described by way of example only and with reference to the accompanying drawings, in which:

DETAILED DESCRIPTION OF THE PREFERRED EMBODIMENTS

Transport of viscous oil over a longer pipeline distance can be facilitated by creating a continuous water phase at the start of the pipeline. A water-continuous phase has a much lower viscosity than the oil-continuous phase and can therefore be transported over larger distances. The inventors have appreciated a limitation with the method of creating water-continuous flow. The flow of oil from the well may be paused for some time period before being restarted again. When restarting, the oil and water will have separated and will not form an emulsion anymore, so starting up will be difficult. Moreover, the oil will have cooled down to the temperature of the surrounding seawater, which further increases the viscosity of the oil and increases the challenges in starting up the flow. The pressure required at the pipe inlet for starting flow will be large, depending on the length of the pipe. The maximum pressure which can be applied to the pipe inlet will depend on the size of the pump which provides the pressure and the safety limit set by the pipe and well system. The length of the pipe will therefore be limited by the maximum allowed pressure for starting up the flow or re-starting the flow.

Figure 1:
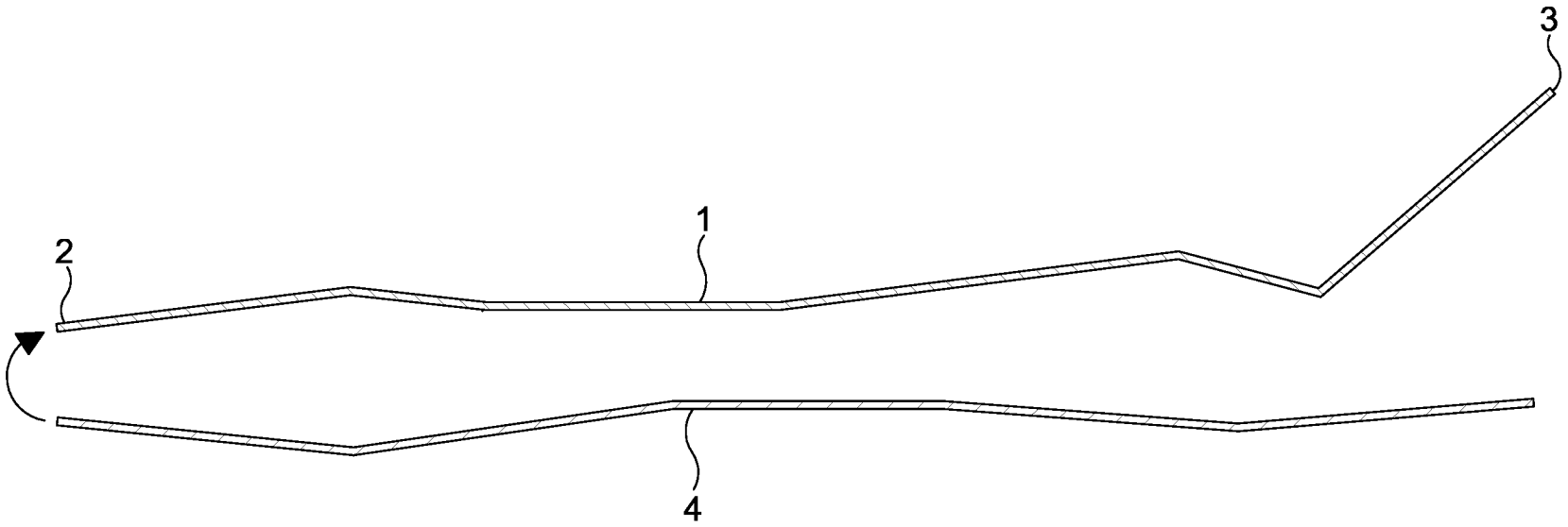
FIG. 1 is a schematic drawing of pipe line assembly.

FIG. 1 illustrates a pipeline 1 with an inlet 2 positioned at the well and an outlet 3 positioned at the FPSO (not shown). The pipeline is not entirely straight as it follows the seabed and bends up towards the FPSO. A second pipeline 4 is provided which supplies water to the inlet 2.

An FPSO is provided in this description by way of example, but the methods and systems described herein are not restricted to use with an FPSO, but can be used with any facility adapted to receive the produced hydrocarbons. For example, oil platforms or land based pipeline receiving facilities can also be used instead of an FPSO each time the example of an FPSO is given.

Figure 2:
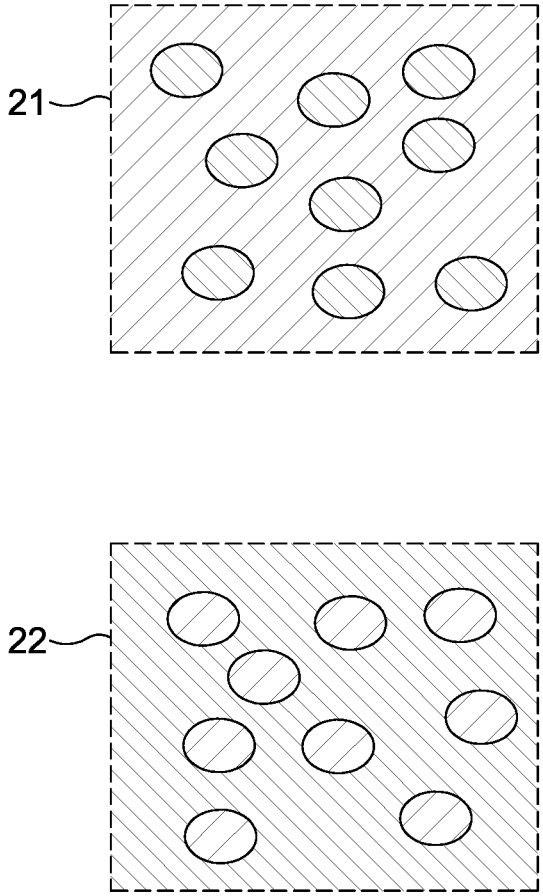
FIG. 2 is a schematic drawing of oil phases.

FIG. 2 illustrates a water continuous phase with an oil-in-water emulsion 21 and an oil continuous phase with a water-in-oil emulsion 22. A water continuous flow will have a much smaller pressure gradient along the length of the pipe when compared to oil continuous flow.

The inventors have realised that some of the problems of the existing technology can be solved using a method of starting up flow of viscous oil in a pipeline sequentially, wherein a first section of the pipeline is provided with water through an inflow control device, the flow of viscous oil within the first section towards the outlet is initiated by pressurising said water, subsequently water is supplied to a second section of the pipeline through a further inflow wherein the first section is closer to the outlet of the pipeline than the second section; and finally initiating a flow of viscous oil within the second section towards the outlet by pressurising said water.

The viscous oil is initially in an oil-continuous phase and the supply of water flips the phase to water-continuous sequentially in the first and second sections.

Figure 3:
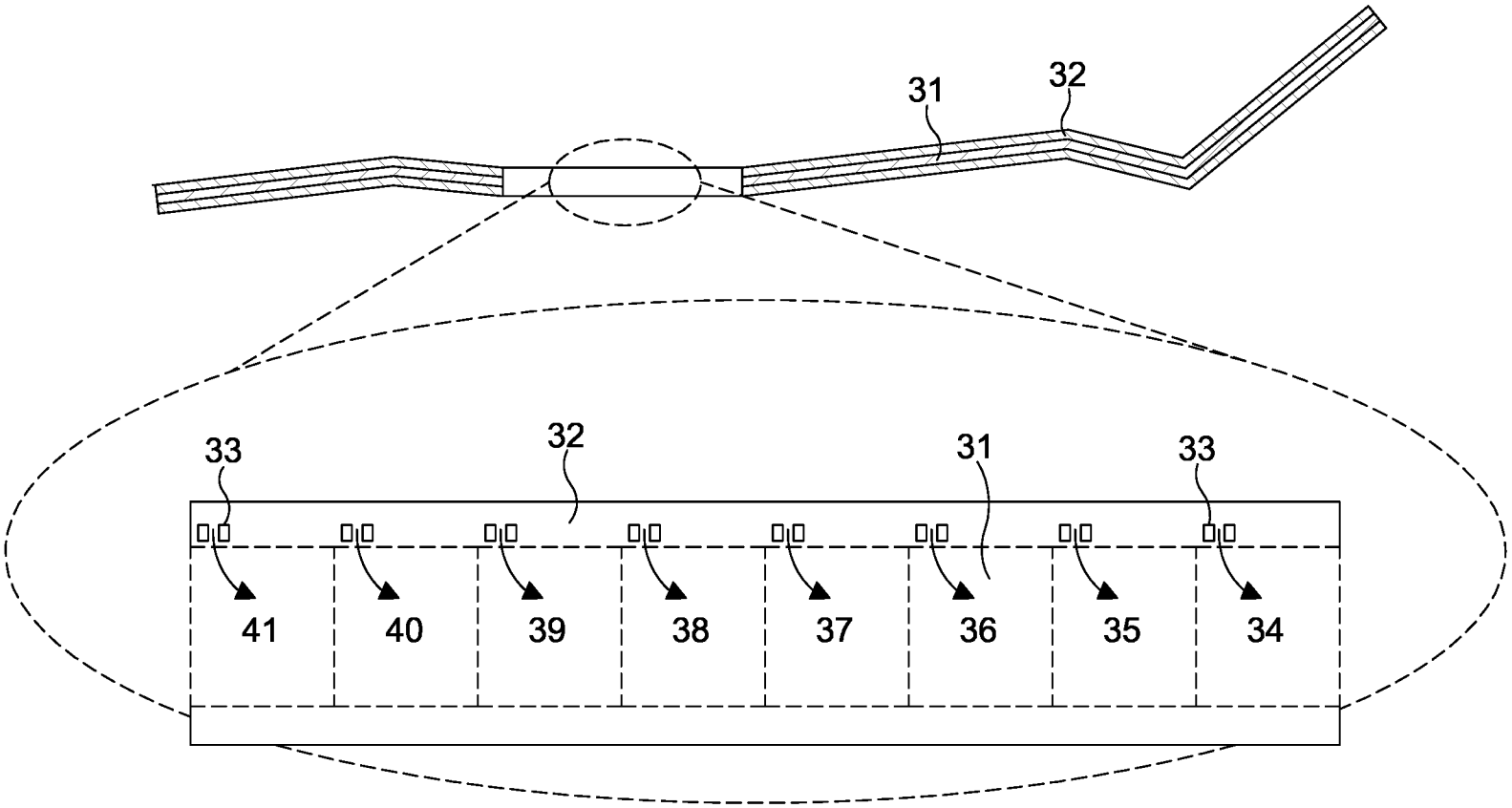
FIG. 3 is a schematic illustration of a pipe line assembly.

FIG. 3 illustrates a first embodiment of the invention. A flow line is provided which comprises an inner pipeline 31 with a flow including oil from the well towards the FPSO, and an outer pipeline 32 with a flow of water in the opposite direction from the FPSO towards the well. A plurality of inflow control devices 33 is provided, which control the flow of water from outer pipeline 31 onto inner pipeline 32. Each inflow control device 33 controls inflow into a section of the inner pipeline, and in FIG. 3 the sections are numbered 34 to 41. Although the sections in the drawing are separated by vertical lines, there are no physical barriers between the different sections in the inner pipeline and the inner pipeline is smooth such that pigging is possible. In this specific embodiment, the inflow control devices 33 are provided at the top of the inner pipeline 32.

Water in outer pipeline 32 can also flow in the same direction as the flow within inner pipeline 31 and the start-up process would work in the same way, but in practice the water flow tends to be generated at the FPSO and therefore flows in the direction opposite to the flow within the inner pipeline 31.

Figure 4:
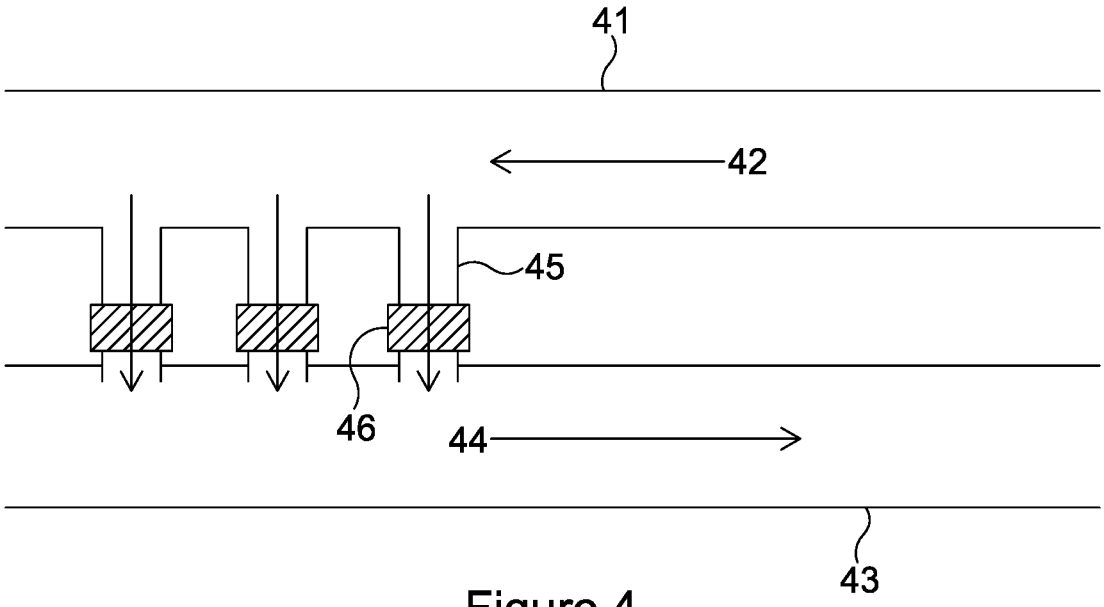
FIG. 4 is a schematic illustration of an alternative pipe line assembly.

An alternative embodiment is similar to the system illustrated in FIG. 4, but with the inflow control devices positioned such that they work in reverse and allow fluid to flow from the inner pipeline 32 into the outer pipeline 31. Water flows in the inner pipeline in a first direction and a mixture of fluids including oil and water flows in the opposite direction through the outer pipeline. As drawback of this embodiment is that the outer pipeline is not 'piggable', i.e. it is more difficult or impossible to run a cleaning device such as a pig through the annulus between the inner pipeline and outer pipeline.

FIG. 4 illustrates an alternative embodiment in which two adjacent pipelines are used instead of two concentric pipelines as in the previous embodiment. A first pipeline 41 supports a flow of water in a first direction 42, while a second pipeline 43 supports a flow of a mixture of fluids including oil and water in a second direction 44. The second direction 44 is opposite to the first direction 42. The first pipeline is connected to the second pipeline by way of a plurality of small pipelines 45. Each small pipeline 45 is provided with an inflow control device 46 which controls the flow of water from the first pipeline 41 into the second pipeline 43. Only three small pipelines 45 are illustrated but they will be provided all along the second pipeline at regular intervals. The inflow of water into the second pipeline 43 preferably takes place from the top of pipeline 43 because viscous oil typically aggregates at the top of the pipeline. Alternatively, the inflow of water from the top can form a thin film between the wall of the pipeline and the viscous oil and so lubricate a laminar flow of oil in the pipeline. The process of inflow of water to flip the phase is described in more detail below.

Figure 5:
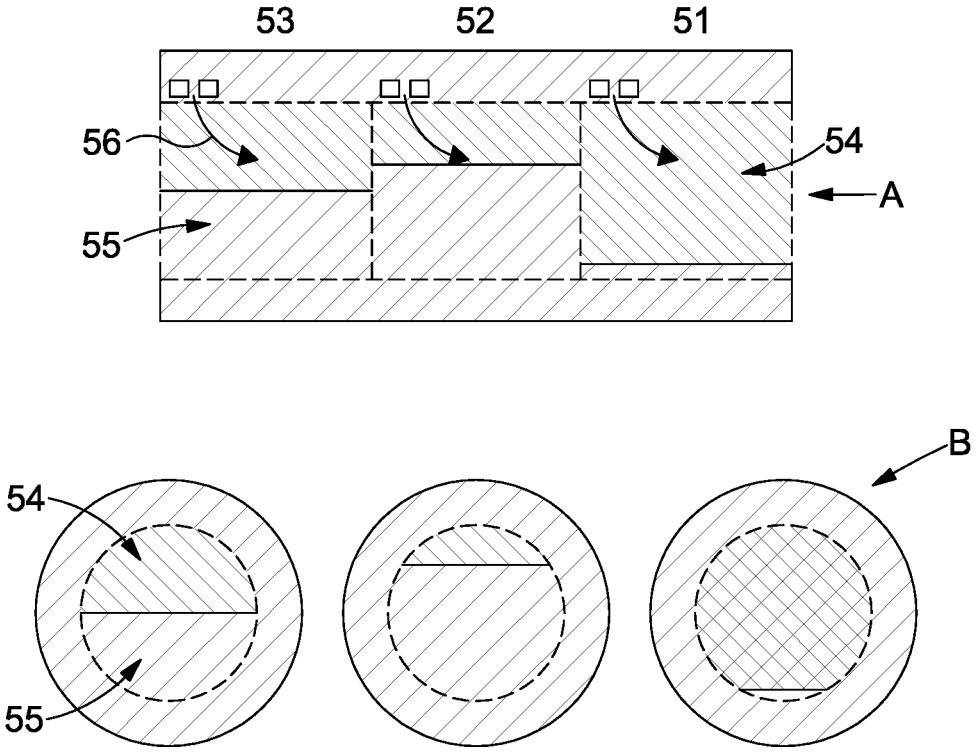
FIG. 5 is a detail of the illustration of FIG. 3.

FIG. 5 illustrates the embodiment of FIG. 3 in more detail. Three sections (51, 52, 53) are illustrated in a vertical cross section along the longitudinal direction of the pipeline (A) and in a vertical cross section in a direction perpendicular to the longitudinal direction of the pipeline (B). The top part of the inner pipeline contains viscous oil (54) which is stationary within the inner pipeline, while the bottom part 55 contains water. The arrow 56 indicates the inflow of water from the outer pipeline into the inner pipeline through the inflow control device.

The valves used for the inflow control devices require specific characteristics to work. The section of the pipeline closest to the FPSO will start to move towards the FPSO before sections further away start moving because the frictional resistance of the viscous oil is smaller for the closest section when compared to sections further away. The inventors have appreciated that using standard one-way valves would not be preferable. If standard one-way valves are used, the section of the pipeline closest to the FPSO will start moving first and then the water in the outer pipeline will follow the path of least resistance and flow through that section without starting up adjacent sections. It is therefore preferable that the inflow control device reduces the inflow of water as soon as the phase is flipped from oil-continuous to water-continuous and as soon as the oil starts moving towards the FPSO.

The inflow control device can be an actively controlled device which includes a control unit arranged to control the amount of water which flows into the inner pipeline. The control unit can be provided locally or remotely. A local sensor may also be provided to detect the amount of water which flows into the inner pipeline at the inflow control device.

Alternatively, an autonomous inflow control valve (AICV) could be used. Autonomous valves are self-controlled and are able to selectively open or close depending on the fluids provided. For example, they can be designed such that they let through oil but close when the water or gas content increases above a predetermined level. Alternatively, they can be arranged to let gas through but not water or oil. Autonomous valves can be tailored for a particular application. Autonomous valves are usually used downhole to control the inflow of production fluids, but the inventors have realised that they may be used in the different context of the present application. The inventors have appreciated that an autonomous valve can be used in the present embodiments which lets water through but which closes at negative pressures such that there is no backflow into the annulus between the outer pipeline and the inner pipeline, and which also closes if the pressure differential between the annulus and the inner pipeline exceeds a threshold.

Figure 6:
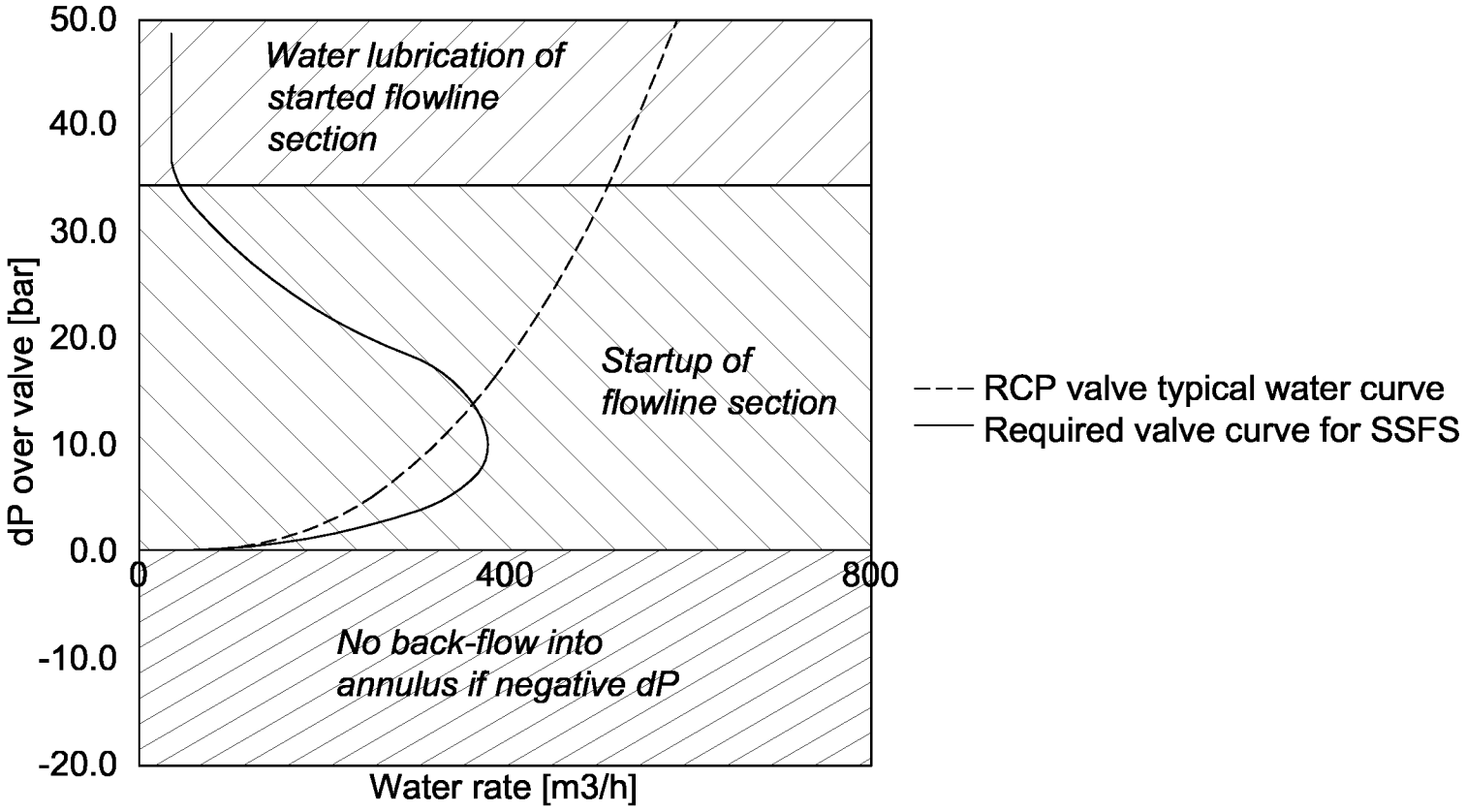
FIG. 6 is a graph of valve characteristics.

FIG. 6 illustrates a curve for a sequential startup of flowline sections (SSFS) and a conventional autonomous valve for comparison. The horizontal axis shows the rate of water flow in cubic metres per hour and the vertical axis shows the pressure differential over both sides of the valve in bar. As shown in the graph, the SSFS valve closes for negative pressure differentials, like the conventional valve, such that there is no back-flow into the annulus. For positive pressure differentials, the inflow first increases but then decreases again. At higher pressure differentials (over 35 bar in the figure), the SSFS valve is not completely closed and there is some residual flow of water into the inner pipeline. This water can be used as water lubrication for stratified flow, or for keeping the water-continuous phase flow moving after startup.

The specific embodiment of the SSFS valve is that a pilot-stream flows via a coiled tubing (not shown in the drawings) which is wrapped around the outside of the inner tubing, from the high pressure side of the valve (the annular region) to the lower pressure tubing. In an SSFS setup the pilot-flow, together with the main flow that is to be controlled, will be single phase water. The valve body in itself (the machined component to which the coiled tubing is attached) is operated by the pilot-stream and associated hydraulics. The AICV valve characteristics are modified by adjusting the coiled tubing length and diameter.

Figure 7:
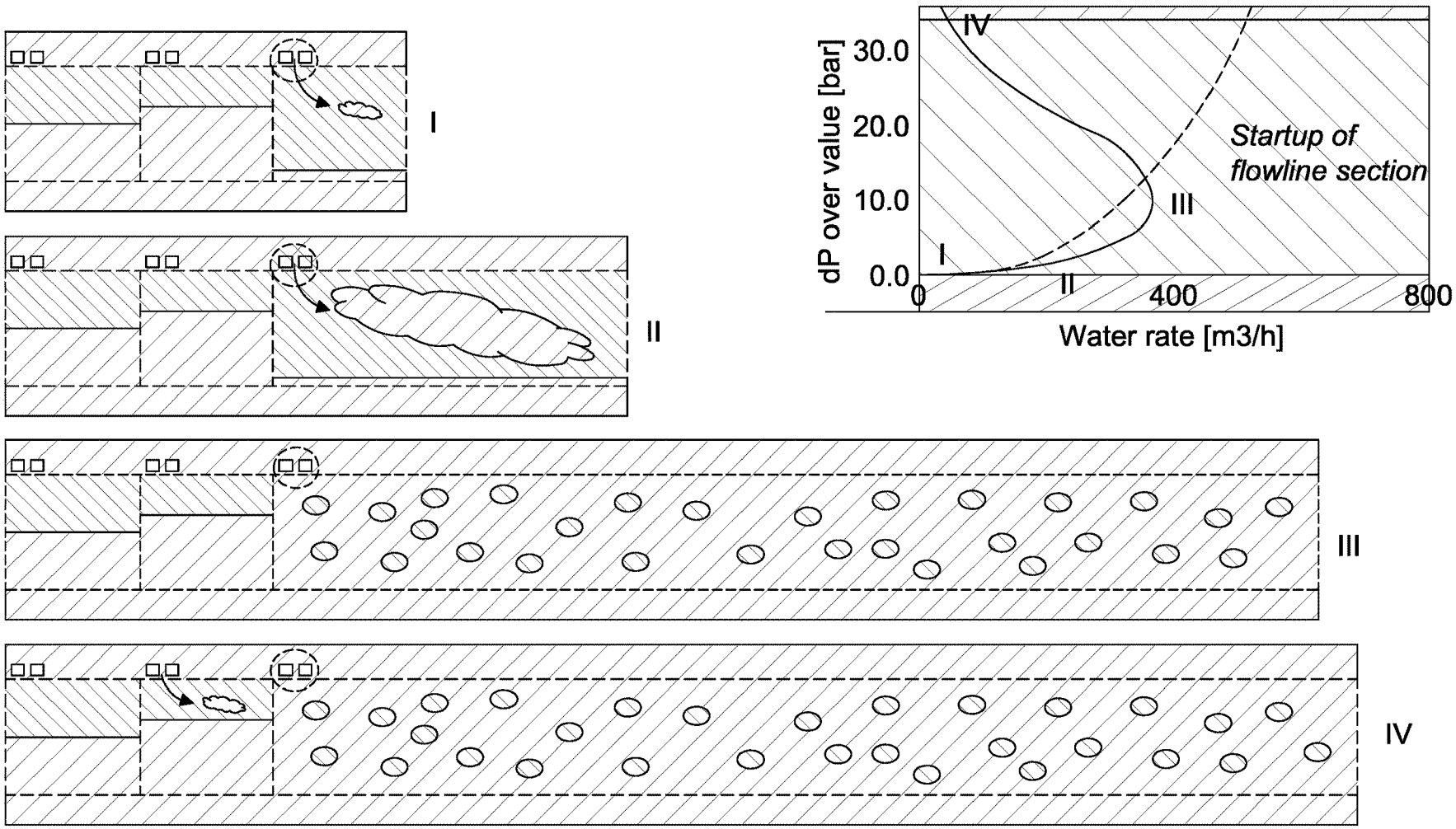
FIG. 7 illustrates different stages of a startup method.

FIG. 7 illustrates four steps of the startup process. The inset is a copy of FIG. 6 with the four steps indicated. Step 1 illustrates three sections with highly viscous oil stationary like in the three sections of FIG. 5. The rightmost section of step 1 shows that some water has entered the inner pipeline from the annulus. In step 2, the amount of water which has entered the rightmost section has increased and the flowrate of water into the section has also increased, as shown in the inset. The adjacent sections do not yet show a significant amount of water entered from the annulus. In step 3, the phase has been flipped by the inflow of water and the water-continuous fluid is flowing towards the FPSO. In step 4, the same process as for the rightmost section starts with the adjacent section and some water enters through the inflow device into the section. The inflow device of the rightmost section now closes almost entirely, as shown in the inset of FIG. 7.

By way of example of the benefits of the present method, a long flow line is provided utilizing a regular flip-water flowline configuration with flip water added to the flowline inlet only (FIG. 1). In order to restart this flow line a large and expensive booster pump with a pump head of 100 bar is needed to supply flip-water to the flowline inlet. Using the present method, 10 AICDs/ICDs are distributed evenly along the production tubing. The booster pump head required to restart the same flow line will now be be only ~10 bar due to shorter sections, 1/10 of the full flowline length, which are started one at the time.

Under regular production the present method will also be very advantageous. For example, a long distance transport of stratified oil-water takes place over a distance of 110 km. Stratified oil-water flow will give a relatively high frictional pressure drop due to viscous oil wetting the upper part of the pipe periphery. However, with the present method, water entering the production tubing via AICDs/ICDs may be utilized to lubricate the zone in between the viscous oil and the wall, hence giving a much lower overall frictional DP. We regard this technology as enabling as it has potential to increase the maximum flowline length beyond the limits regarded as governing today.

Temperature of the water can be used as a further optional control parameter. Heated water can be used to reduce viscosity of the oil during startup. However, once the phase has been flipped to water-continuous then the increased temperature will have limited effect on the viscosity of the fluid and it may be more energy efficient not to heat the water.

Figure 8:
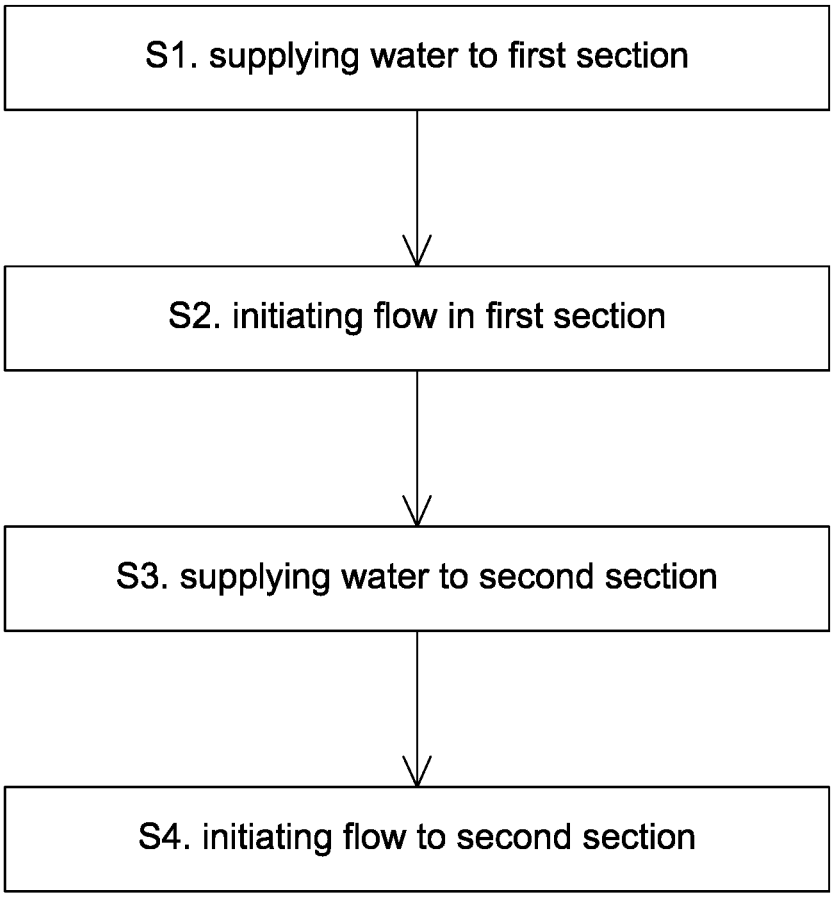
FIG. 8 illustrates a method.

FIG. 8 is a flow diagram of the method described herein, comprising the steps of supplying water to the first section (S1), initiating flow in the first section (S2), supplying water to the second section (S3) and initiating flow to the second section (S4).

Although the invention has been described in terms of preferred embodiments as set forth above, it should be understood that these embodiments are illustrative only and that the claims are not limited to those embodiments. Those skilled in the art will be able to make modifications and alternatives in view of the disclosure which are contemplated as falling within the scope of the appended claims. Each feature disclosed or illustrated in the present specification may be incorporated in the invention, whether alone or in any appropriate combination with any other feature disclosed or illustrated herein.

The invention claimed is:

1. A method of starting up flow of viscous oil in a pipeline, wherein the pipeline has an inlet and an outlet and wherein the viscous oil is initially stationary within the pipeline, the method comprising:

supplying water to a first section of the pipeline through an inflow control device;

initiating a flow of viscous oil within the first section towards the outlet by pressurising said water;

supplying water to a second section of the pipeline through a further inflow control device wherein the first section is closer to the outlet of the pipeline than the second section;

initiating a flow of viscous oil within the second section towards the outlet by pressurising said water, and repeating said steps of supplying water and initiating a flow of viscous oil for a plurality of further sections, wherein said steps of supplying water and initiating a flow for each one of a plurality of further section takes place before said steps of supplying water and initiating a flow for any other one of the plurality of further sections which are closer to the inlet than each one of the plurality of further sections.

2. The method of claim 1, wherein said viscous oil is initially in an oil-continuous phase and wherein the method further comprises flipping the phase in the first section to water-continuous by the step of supplying water.

3. The method of claim 2, further comprising flipping the phase in the second section to water-continuous by the step of supplying water after flipping the phase in the first section to water continuous.

4. The method of claim 1, further comprising reducing the amount of water supplied to the first or second section after initiating the flow of viscous oil.

5. The method of claim 1, wherein the inflow control device is an autonomous inflow valve.

6. The method of claim 1, wherein the inflow control device is a valve which is controlled locally or remotely with a controller.

7. The method of claim 1, wherein said flow of viscous oil is laminar flow.

8. The method of claim 1, wherein water is supplied through a conduit parallel to the pipeline and wherein the water flows in a direction opposite to said flow of viscous oil.

* * * * *